US005407192A

United States Patent [19]

Ueda et al.

[11] Patent Number: 5,407,192

[45] Date of Patent: Apr. 18, 1995

[54] SORTER HAVING A PIVOTING NON-SORT BIN

[75] Inventors: Masahiro Ueda, Ibaraki; Yasuhiro Fujimoto, Iruma; Terutoshi Nakao, Ibaraki, all of Japan

[73] Assignee: Riso Kagaku Corporation, Tokyo, Japan

[21] Appl. No.: 60,933

[22] Filed: May 13, 1993

[30] Foreign Application Priority Data

May 19, 1992 [JP] Japan ..... 4-032933
May 19, 1992 [JP] Japan ..... 4-126265

[51] Int. Cl.[6] ..... B65H 39/10

[52] U.S. Cl. ..... 271/289; 271/294; 271/298; 271/223

[58] Field of Search ..... 271/288, 289, 292, 293, 271/294, 298, 213, 214, 223

[56] References Cited

U.S. PATENT DOCUMENTS 4,343,463 8/1982 Lawrence ..... 271/294 X
5,255,908 10/1993 Hiroi et al. ..... 271/294 X

*Primary Examiner*—Robert P. Olszewski
*Assistant Examiner*—Boris Milef
*Attorney, Agent, or Firm*—Kanesaka & Takeuchi

[57] ABSTRACT

A sorter for sorting sheets successively supplied thereto, comprising: a fixed frame; a movable frame movable vertically with respect to the fixed frame; a plurality of bins arranged one over another at a predetermined distance and each having an upper surface sloping upwardly in a sheet supply direction for receiving thereon one or more of the sheets, the bins being supported on the movable frame; a non-sort bin situated upwardly of the bins and supported pivotally on an upper portion of the movable frame for receiving the non-sorted sheets, the non-sort bin being biased normally so as to slant upwardly in the sheet supply direction; and a holder mounted on the fixed frame, at a position to which the sheets are to be supplied, for holding the non-sorer bin horizontally against the bias.

5 Claims, 10 Drawing Sheets

SORTER HAVING A PIVOTING NON-SORT BIN

BACKGROUND OF THE INVENTION

1. Field of the Invention

This invention relates to a sorter for distributing or sorting copied or printed sheets from a copier or a printer onto a plurality of tins arranged one over another, and more particularly to a sorter equipped with a plurality of sort bins and a non-sort bin.

2. Description of the Related Art

FIG. 5 of the accompanying drawings shows a conventional sorter in which a plurality of bins arranged vertically one over another in an inclined posture and held by a movable frame 2 are moved individually by a lift (not shown) mounted on a fixed frame 3 and are moved collectively by moving the movable frame 2 vertically.

Assuming that the printed sheets are sorted by the conventional sorter, since the upper surface of the individual bin 1 slants upwardly in the sheet supply direction, the leading edge and the lower surface of a sheet slides upwardly on the printed surface of the previously received sheet as it climbs the slant surface of the bin 1.

During the sorting, even though ink on the printed sheet has been dried inadequately, it is possible to secure adequate time by sorting the printed sheets on the plural bins 1 in a predetermined order, thus keeping the printed sheets free from being stained with ink when the next sheet comes in.

In the case of non-sorting, namely, in the case where the printed sheets are received on only the uppermost bin la without being sorted, since sufficient time cannot be secured to dry ink on the printed sheet, the leading edge of an incoming printed sheet will slide on the undried surface of the previous printed sheet existing on the bin la so that the successively received sheets would stain one another, at which time the print image on the printed sheet previously received would be transferred to the back surface of the next printed sheet, which is known as a transfer-to-the-back phenomenon.

A solution to this problem was considered in which, as shown in FIG. 6, a horizontal bin 1b dedicated for non-sorting was fixedly attached to the uppermost portion of the sorter to receive the non-sorted sheets only.

With this horizontal fixed bin, it was successful to prevent the successive printed sheets from staining one another due to the frictional contact of the incoming sheet with the previous one; in sorting, however, since the sheet receiving side of the sorter becomes higher, a document feeder or other serving mechanism, if constructed so as to project from the top of the sorter, would be obstructed by the horizontal fixed bin 1*b*. Yet if the total number of bins could be reduced in an attempt to minimize the entire height of the sorter, it would deteriorate the sorting performance.

SUMMARY OF THE INVENTION

With the first-named problems in view, it is an object of this invention to provide a sorter in which despite of using a non-sort bin, printed sheets can be collected one over another on the non-sort bin without staining one another due to the frictional contact of adjacent sheets and in which despite of using the non-sort bin, the sorting performance would not be deteriorated and the sheet receiving side would not become higher.

According to the first invention as defined in claim 1, there is provided a sorter for sorting sheets successively supplied thereto, comprising:

(a) a fixed frame;

(b) a movable frame movable vertically with respect to the fixed frame;

(c) a plurality of bins arranged one over another at a predetermined distance and each having an upper surface sloping upwardly in a sheet supply direction for receiving thereon one or more of the sheets, the bins being supported on the movable frame;

(d) a non-sort bin situated upwardly of the bins and supported pivotally on an upper portion of the movable frame for receiving the non-sorted sheets, the non-sort bin being biased normally so as to slant upwardly in the sheet supply direction; and (e) a holder mounted on the fixed frame, at a position to which the sheets are to be supplied, for holding the non-sort bin horizontally against the bias.

According to the invention as defined in claim 2. the sorter further comprises a stopper movable vertically with the movable frame for holding, in place of the holder, the non-sort bin at a sort position in which the sheets are to be sorted.

According to the invention as defined in claim 3, the non-sort bin is equipped with an extender extendible in the sheet supply direction.

According to the invention as defined in claim 4, the sorter further comprises a resilient member situated between the non-sort bin and the movable frame for normally biasing the non-sort bin.

According to the invention as defined in claim 5, the sorter further comprises:

(a) a stopper situated at a downstream end of the non-sort bin for contact with the leading end of the individual sheet supplied to the non-sort bin;

(b) a pair of guide members situated on opposite sides of an upstream end of the non-sort bin, each of the guide member having a sheet guide surface slanting upwardly in the sheet supply direction and downwardly toward the center of the non-sort bin perpendicularly to the sheet supply direction.

With this first arrangement, when all the bins are lowered to bring the uppermost non-sort bin to a position confronting the sheet discharge position, the non-sort bin will contact the holder on the fixed frame and thereby kept in a horizontal posture so that the leading edge of the next printed sheet will not slide on the surface of the previous printed sheet when the printed sheets are received successively on the non-sort bin.

When the sort bins are brought to a position confronting the sheet discharge position, the sheet discharge side of the non-sort bin will be urged, by gravity or a spring, to pivotally move downwardly lower than the upper or sheet discharge portion of the sorter.

Another object of the invention is to provide a sorter in which the previously received printed sheet is prevented from being frictionally contacted by the incoming printed sheet when the printed sheets are successively discharged to the sorter.

According to the second invention as defined in claim 6, there is provided a sorter for sorting sheets successively supplied thereto, comprising:

(a) a fixed frame;

(b) a plurality of bins arranged one over another at a predetermined distance for receiving the sheets in sorts and movable vertically with respect to the fixed frame;

(c) a base movable, with the bins, vertically with respect to the fixed frame for receiving the non-sorted sheets at a position to which the sheets are to be supplied;

(d) a pair of guide members situated on opposite sides of an upstream end of the base, each of the guide member having a sheet guide surface slanting upwardly in the sheet supply direction and downwardly toward the center of the base perpendicularly to the sheet supply direction; and (e) a stopper situated at a downstream end of the base for contact with the leading end of the individual sheet flied over the guide members.

According to the invention as defined in claim 7, the position of the stopper is adjustable in the sheet supply direction.

According to the invention as defined in claim 8, the sorter further comprises a pair of guiding side plates situated on the base for truing up the opposite side edges of the sheets, the guiding side plates being situated downstream of the respective guide members.

According to the invention as defined in claim 9, the sheet guide surface of each the guide member is a curved surface.

DETAILED DESCRIPTION

A first embodiment of this invention will now be described in detail with reference to the accompanying drawings.

Figure 1:
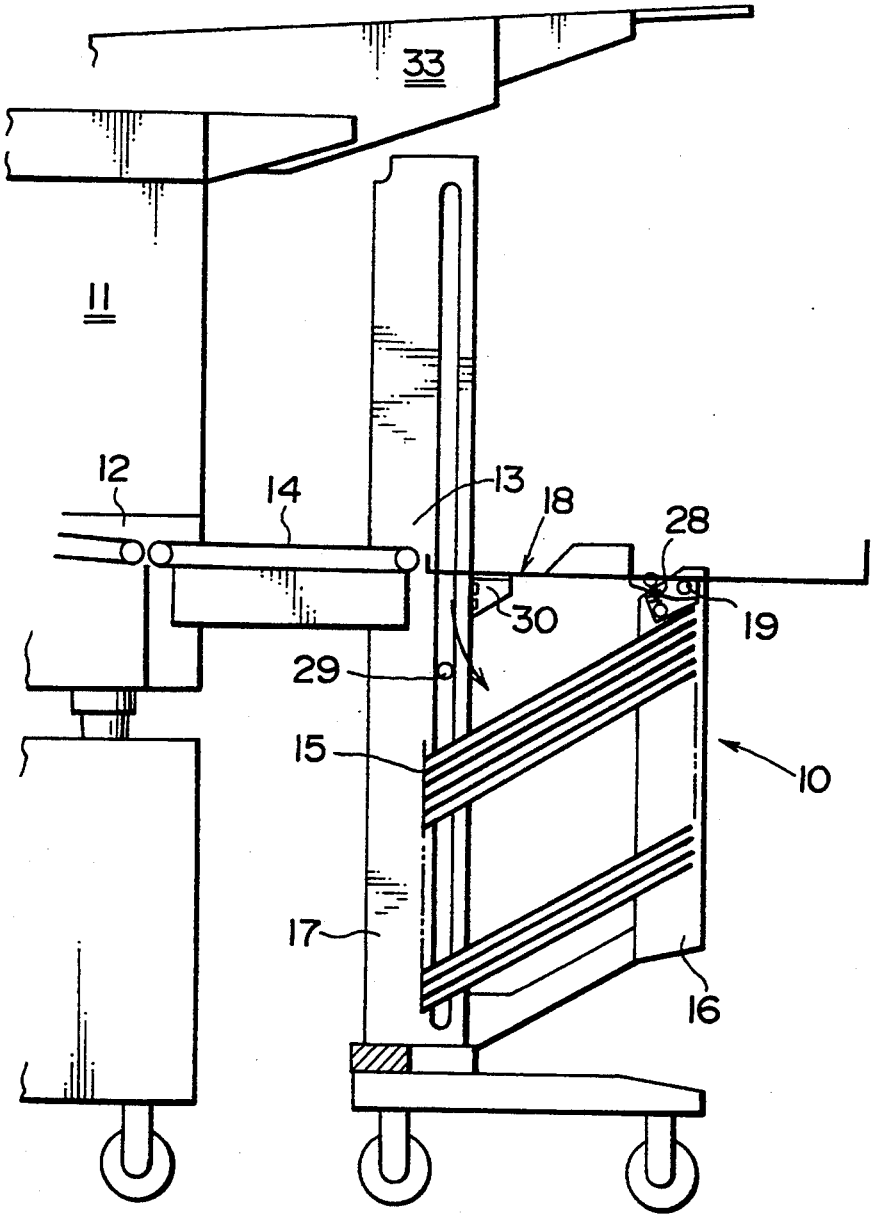
FIG. 1 is a fragmentary front view of a sorter according to a first embodiment of this invention.
Figure 2:
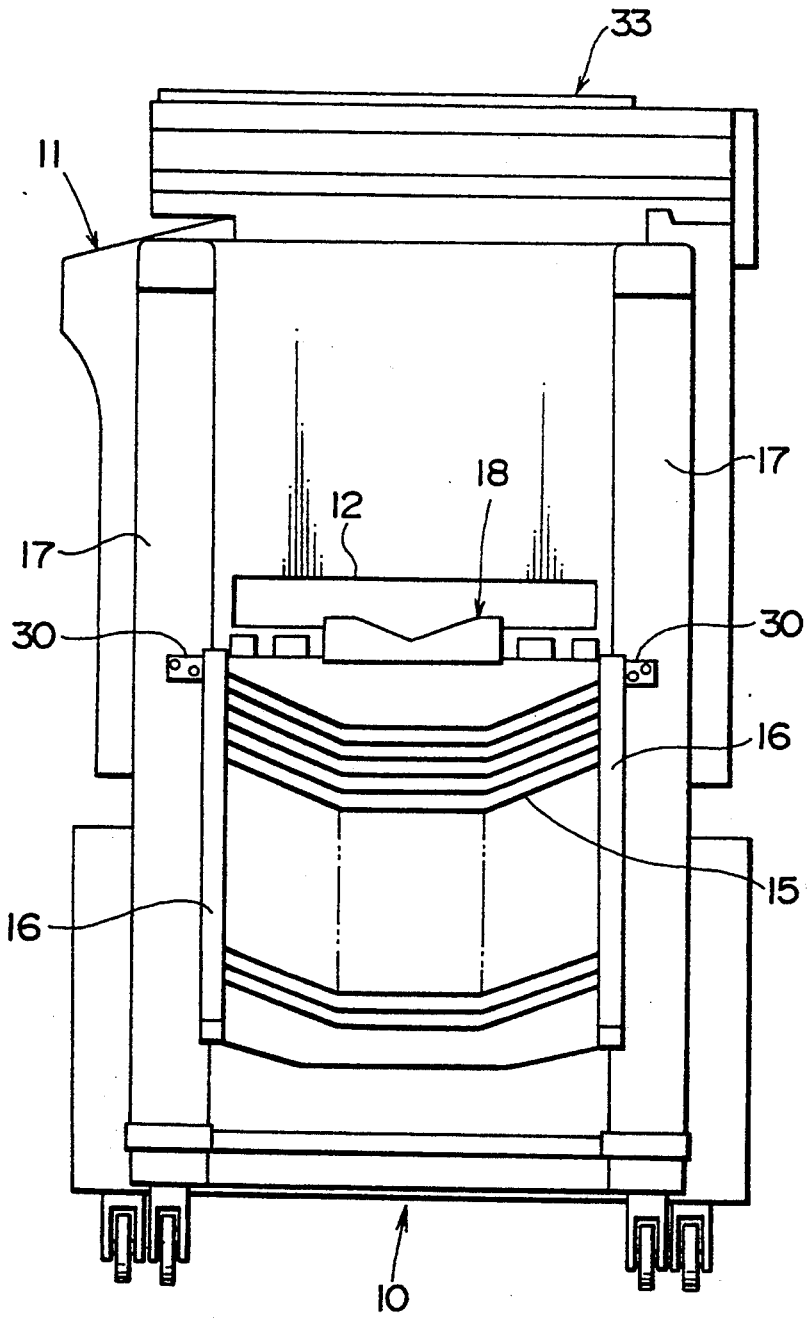
FIG. 2 is a side view of the sorter of the first embodiment.

FIGS. 1 and 2 show a sorter 10 connected with a treatment apparatus in the form of a printer 11. The sorter 10 is situated in a confronting relationship to the sheet discharge side of the printer 11, An endless conveyer belt 14 extends between a sheet discharge port 12 of the printer 11 and a sheet receiving port 13 of the sorter 10 to introduce into the sorter 10 successive printed sheets discharged from the printer 11.

The sorter 10 has a plurality of sort bins 15 arranged one over another and held, by a movable frame 16, slanting upwardly in the sheet supply direction. The sort bins 15 are moved, with the movable frame 16, upwardly or downwardly along a fixed frame 17 by a lift (not shown) so as to come orderly to a position confronting the sheet receiving port 13 of the sorter 10.

Situated upwardly of sort bins 15 is a non-sort bin 18 (sheet discharge tray)/a central portion of which non-sort bin 18 is pivotally attached to the movable frame 16 by a pivot 19.

Figure 3:
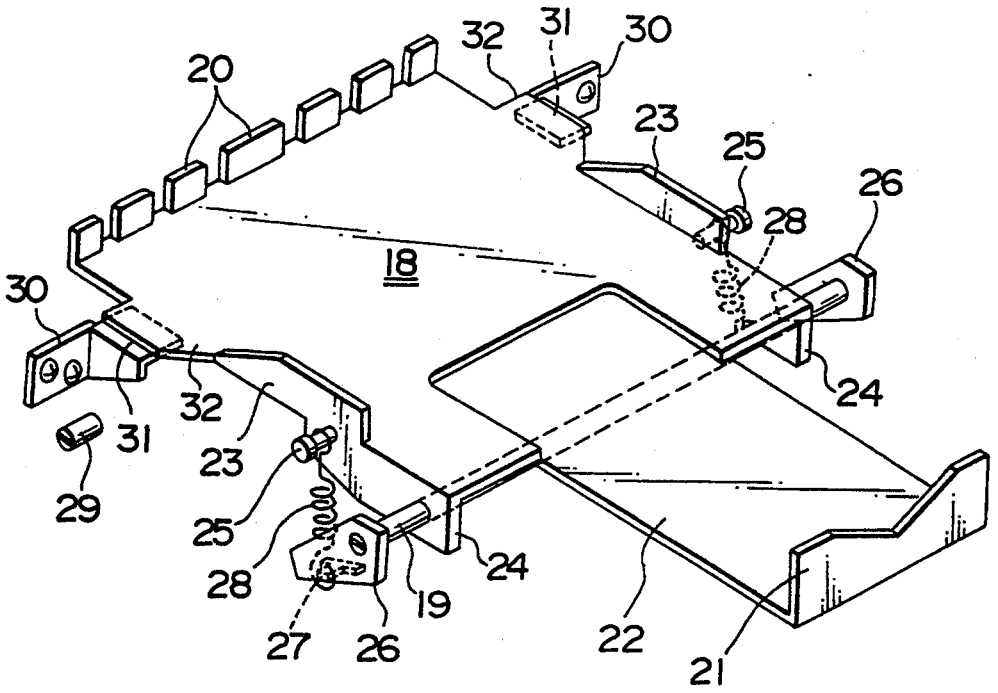
FIG. 3 is a perspective view of a non-sort bin according to the first embodiment.

The non-sort bin 18, as shown in FIG. 3, has on its sheet receiving edge (hereinafter called "upstream end") a series of bumper flanges 20 and on its downstream edge an extender 22 from which another bumper flange 21 is projecting upwardly, and centrally on opposite side edges a pair of upright side flanges 23, 23, thus receiving discharged sheets within a area defined by these flanges.

The non-sort bin 18 also has on the opposite side edges a pair of hanging brackets 24, 24, through which the above-mentioned pivot 19 extends. A pin 25 is mounted on the outside surface of each hanging bracket 24. A pair of locking members 27, 27 are mounted on pair of immovable plates 26, 26, respectively, which are fixedly attached to the inside surfaces of the movable frame 16. A spring 28 is mounted between the respective pin 25 and the respective locking member 27 to normally bias the sheet receiving side (i.e., the upstream end) of the non-sort bin 18 downwardly. At the sort mode, the sheet receiving side (i.e., the upstream end) of the non-sort bin 18 is held in an inclined posture, slanting upwardly toward the downstream end like the sort bin 15, by a stop pin 29 which is operatively connected with the movable frame 16 and is movable in response to upward and downward movements of the movable frame 16.

A holder 30 is attached to the fixed frame 17 for holding the non-sort bin 18 in a horizontal posture at the non-sort mode in which the non-sort bin 18 is located in the sheet receiving position. This horizontal posture is kept as a pair of bumping projections 31, 31 of the holder 30 are in contact with a pair of ears 32, 32, respectively, projecting from opposite side edges of the non-sort bin 18.

At the non-sort mode, as shown in FIG. 1, when the sort bins 15, with the movable frame 16, are moved to the lowermost position, the ears 32, 32 of the non-sort bin 18 will come into contact with the respective bumping projections 31, 31 of the holder 30 secured to the fixed frame 17, so that the non-sort bin 18 is held in a horizontal posture facing the sheet receiving port 13 against the bias of the spring 28.

In this stage, printed sheets discharged from the sheet discharge port 12 of the printer 11 will be introduced to the sorter via the endless belt 14 and are received onto the non-sort bin 18 via the sheet receiving port 13.

At that time, since the leading edge of an incoming printed sheet is kept from any frictional contact with the bottom surface of the non-sort bin 18, the successive printed sheets would be free from staining one another with print ink even if the next printed sheet is discharged to the non-sort bin 18 before the ink on the previously discharged printed sheet has dried up.

Figure 4:
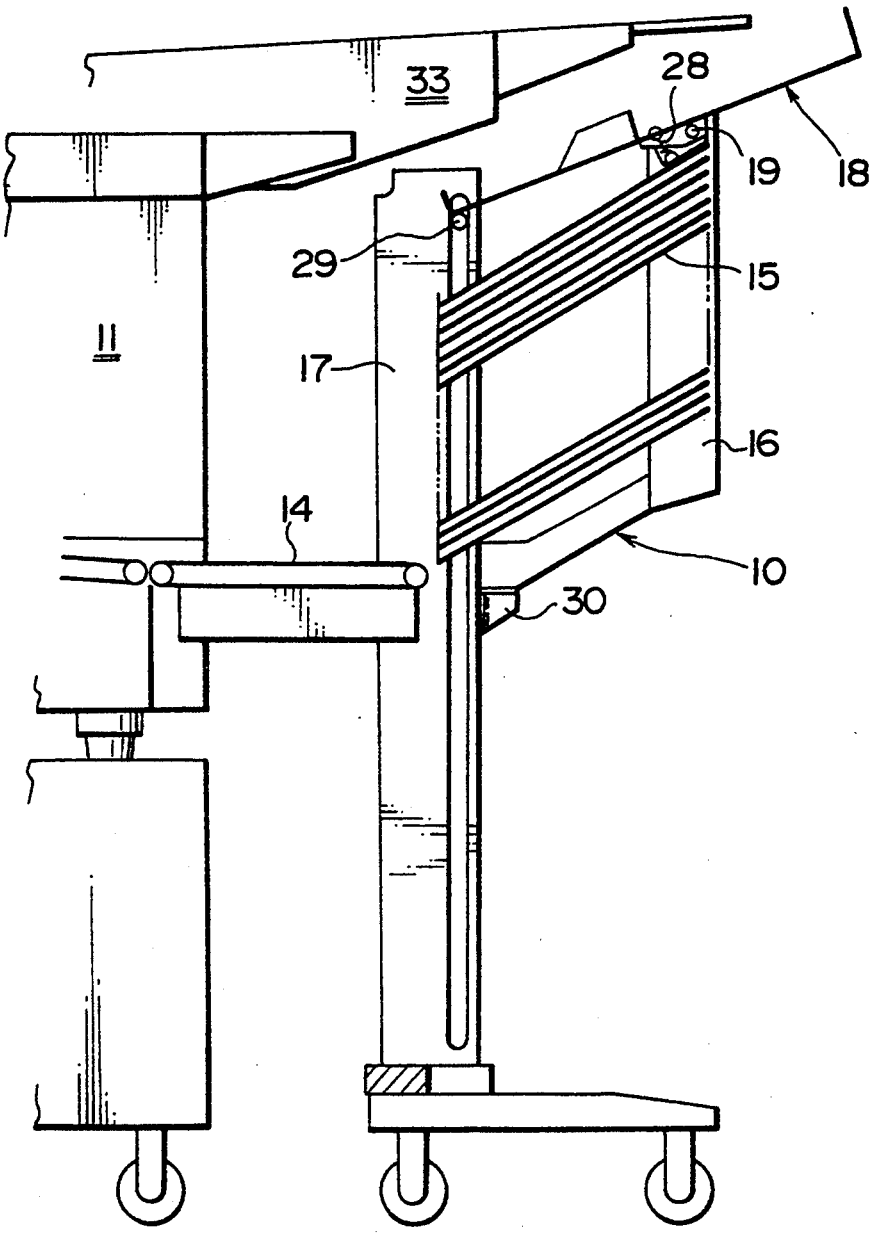
FIG. 4 is a fragmentary front view of the sorter of the first embodiment, illustrating the manner in which printed sheets are sorted.
Figure 5:
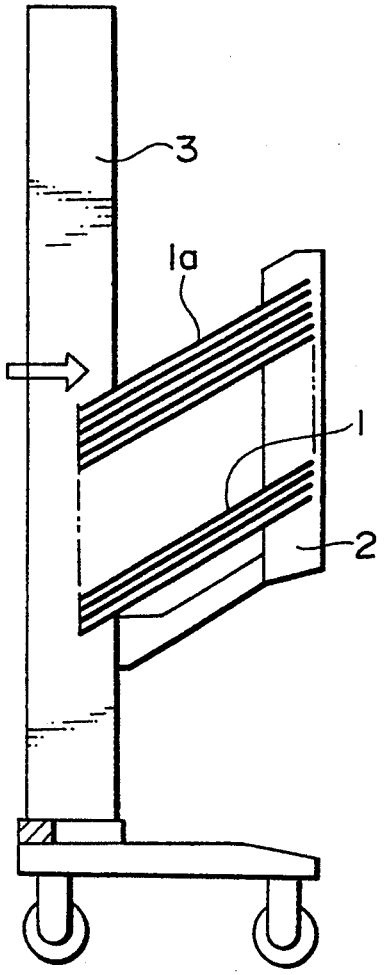
FIG. 5 Prior Art
FIG. 5 is a schematic front view illustrating a prior art problem.
Figure 6:
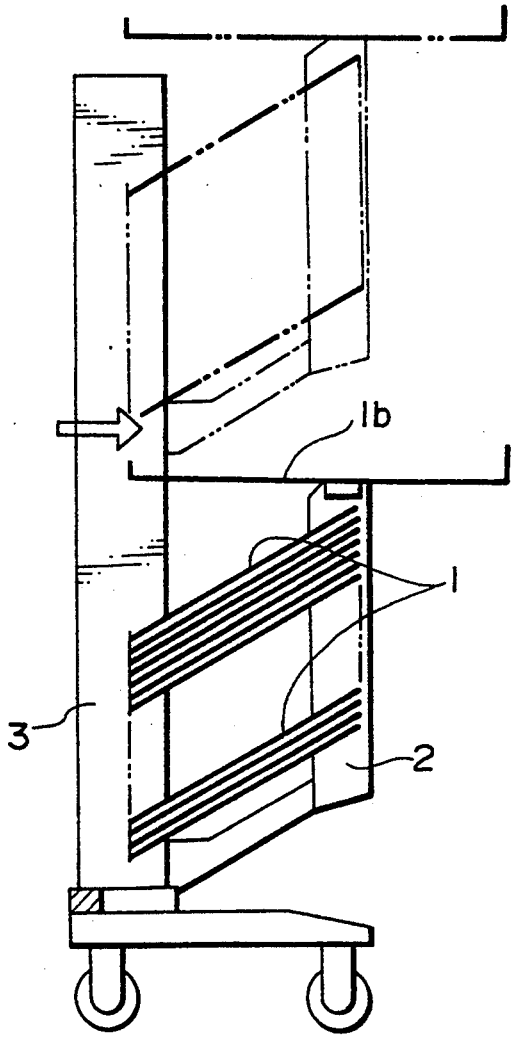
FIG. 6 Prior Art
FIG. 6 is a schematic front view illustrating another prior art problem.

For the sort mode, namely, when the movable frame 16 is raised from the position of FIG. 1 to move the sort bin 15 to the sort position, the non-sort bin 18 will be gradually inclined, slanting upwardly toward the downward end, under the biasing force of the spring 28 to come into contact with the stop pin 29 to thereby keep the horizontal posture, as shown in FIG. 4.

Accordingly, even when the movable frame 16 is moved to the uppermost position, the sheet receiving side of the non-sort bin 18 is so low as not to contact a document feeder 33 or any other part, which is situated in the printer 11, even if projected over the top of the sorter 10.

This invention should by no means be limited to the foregoing embodiment. For example, the extender 22 of the non-sort bin 18 may be angularly movable about the pivot 19 toward the upper surface of the non-sort bin 18, or may be slidable, to make the entire sorter compact in size.

With the foregoing arrangement of this invention, at the non-sort mode, since discharged printed sheets are received successively onto the non-sort bin in the horizontal posture, the leading edge of the next printed sheet will not slide on the undried print surface of the previously received sheet so that the successive printed sheets would be free from staining one another with print ink, even if the print ink on previous printed sheet has not yet dried up, thus improving the quality of the printed sheets.

While the non-sort bin is not used, it assumes its inclined posture like the sort bins. Consequently, a document feeder, or other serving mechanism, projecting from the upper portion of a printer or copier can be prevented from being obstructed by the non-sort bin, thus an effective use of space.

Preferred embodiments of the second invention will now be described in detail with reference to the accompanying drawings.

Figure 7:
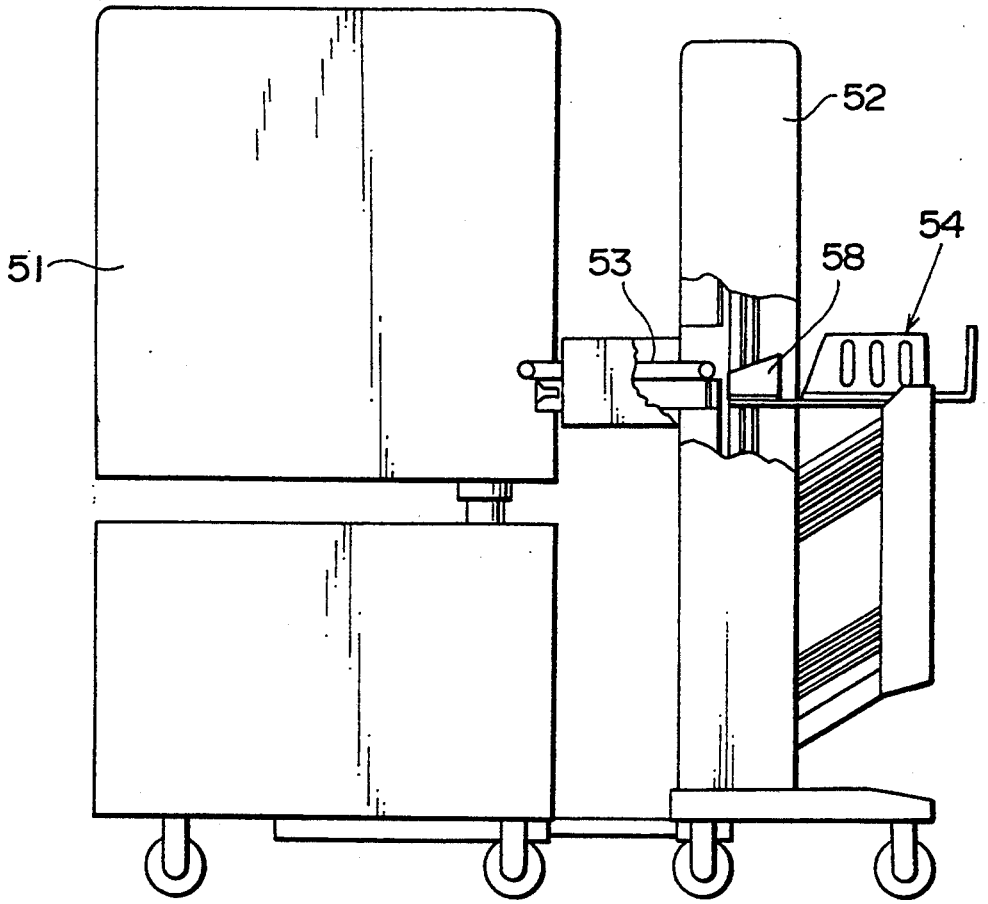
FIG. 7 is a front view showing the whole structure of a sorter according to a second embodiment.

In FIG. 7, reference numeral 51 designates a printer, and 52 designates a sorter; printed sheets discharged from the printer 51 will be conveyed to the sorter 52 by an endless belt 53.

The sorter 52 is detachably connected with the printer 51 for receiving successive printed sheets in sorts and one over another on a plurality of bins at the sort mode and for receiving successively the sheets on a sheet discharge tray 54 in its horizontal posture at the non-sort mode.

Figure 8:
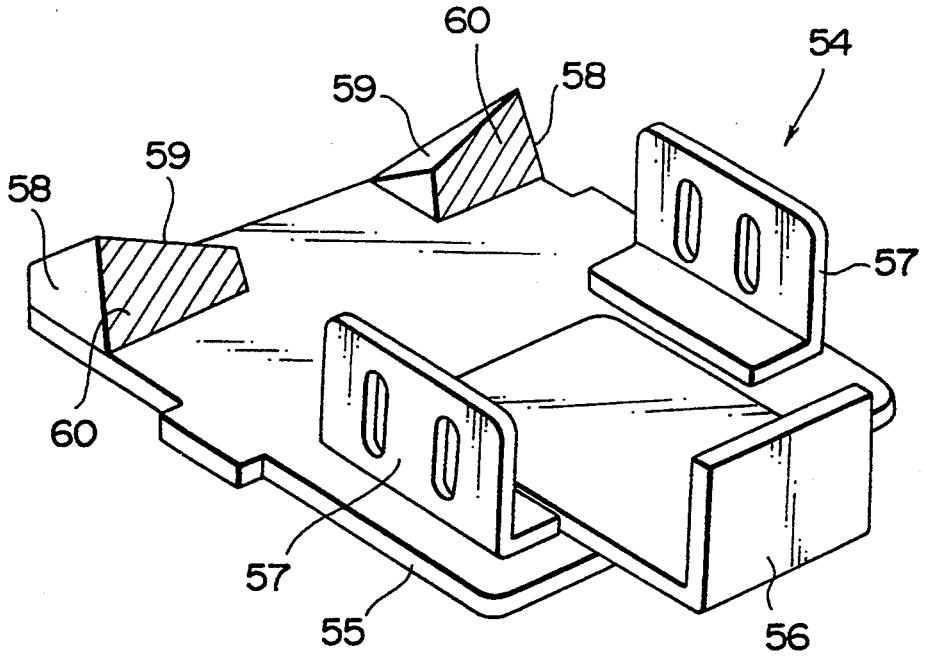
FIG. 8 is a perspective view of the non-sort bin of the second embodiment.

As shown in FIG. 8, the sheet discharge tray 54 serving as a non-sort bin comprises a base 55, a stopper 56 situated on the downstream end of the base 55 against which stopper the leading end of the individual incoming printed sheet is to strike, a pair of guiding side plates 57, 57 situated at opposite sides of the base 55 for guiding the opposite side edges of the individual incoming sheet, and a pair of guide members 58, 58 situated on opposite sides of the base 55 at the downstream end (i.e., the sheet receiving side) thereof.

The guide members 58, 58 guide the individual incoming sheet by their respective slant surfaces 59, 59. These slant surfaces 59, 59 have a height increasing gradually in the sheet supply direction, i.e. toward the stapper 56. As seen along a plane perpendicular to the sheet supply direction, each slant surface 59 is sloping downwardly toward the center of the base, i.e. toward the imaginary center line of the incoming sheet; this is, the slant surfaces 59, 59 are inclined inwardly of the base 5. The downstream end surfaces 60, 60 of the two guide members 58, 58 facing the stopper 56 are perpendicular to the base 55 for positioning the trailing ends of the individual sheets in stack on the base 55.

Figure 9A:
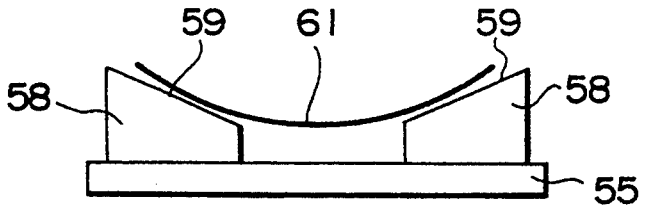
FIGS. 9(*a*) and 9(*b*) illustrate the operation of guide members of the non-sort bin of the second embodiment.
Figure 9B:
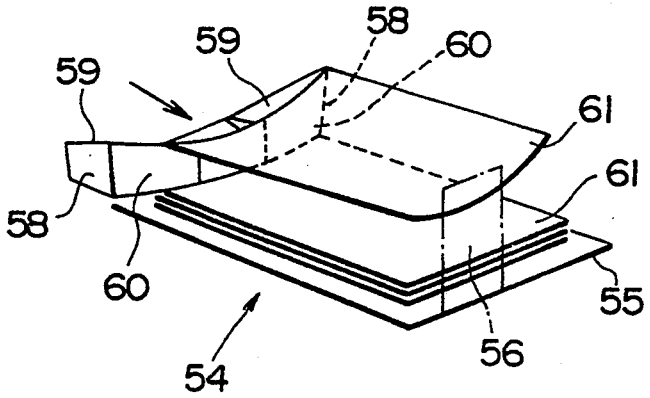

With this arrangement, printed sheets discharged from the printer 51 are conveyed to the sheet discharge tray 54 by the endless belt 53. As shown in FIG. 9, as guided by the slant surfaces 59, 59 of the two guide members 58, 58, the incoming printed sheet 61 will be introduced slightly upwardly toward the stopper 56, assuming a downwardly bulging U-shape posture.

This curved printed sheet 61 will fly over the guide members 58, 58 without contacting the previously discharged printed sheet 61 stacked on the base 55 and will then be stopped when the leading end of the sheet strikes the stopper 56. At that time, if the striking force is relatively great, the individual incoming printed sheet 61 will fall, returning toward the guide member 58, 58; however, since the downstream end surfaces 60, 60 of the guide members 58, 58 are perpendicularly to the base 55, the trailing end of the incoming sheet 61 will come into contact with these downstream end surfaces 60, 60. As a result, the individual printed sheet 61 will fall along the downstream end surfaces 60, 60 and hence the edges of the successive discharged sheets will be trued up so that the individual printed sheets 61 will be piled one over another neatly at a predetermined area on the base 55, without sliding on one another.

Figure 10:
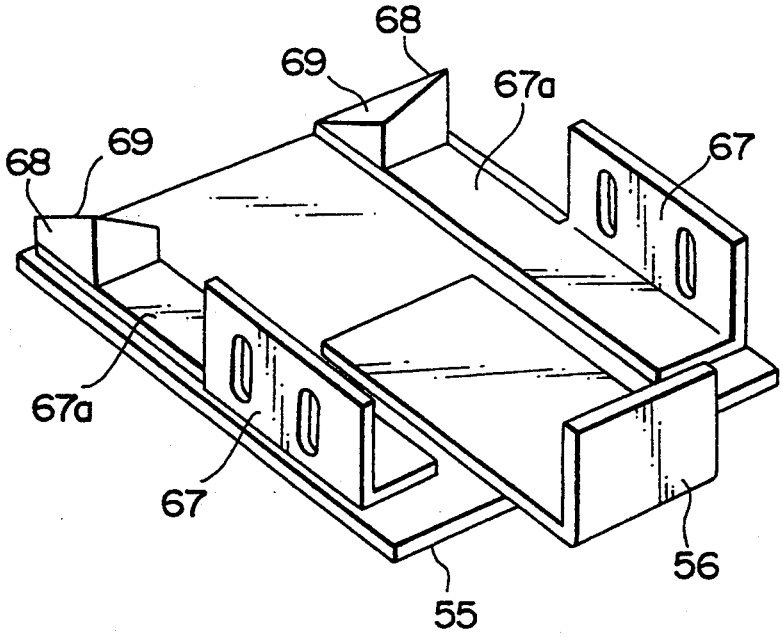
FIG. 10 is a perspective view of a modified non-sort bin according to a third embodiment.

FIG. 10 shows a modified form of guide members 68, 68 according to a second embodiment of the second invention The guide members 68 68 are fixedly attached to the respective bottom plate **67*a* of two guiding side plates 67, 67 for truing up the opposite side edges of the sheets as piled. If the relative position of the guiding side plates 67, 67 is adjusted, the distance between the two guide members 68, 68 also will be automatically adjusted. Each guide members 68 has a slant 69** which is identical in structure with that of the first embodiment of the second invention.

Figure 11:
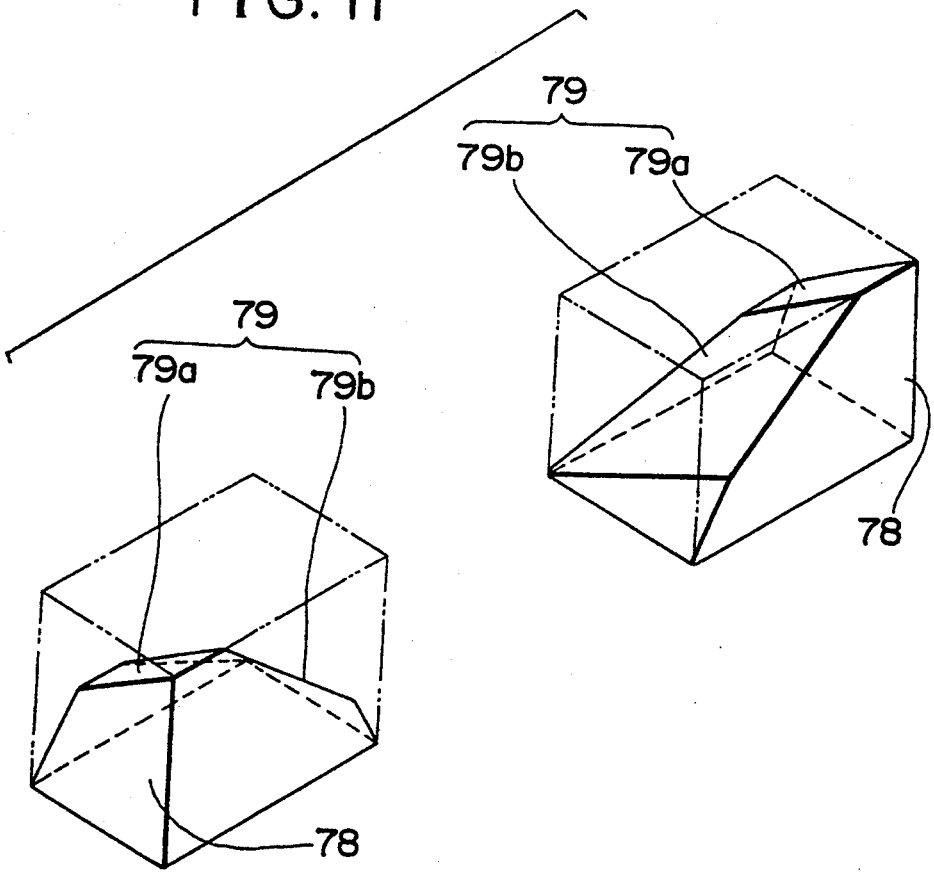
FIG. 11 is a perspective view of modified guide members according to a fourth embodiment.

FIG. 11 shows another modified form of guide members 78, 78 according to a third embodiment of the second invention. In each guide member 78, a slant surface 79 for guiding a sheet is divided into two regions **79*a*, 79*b***.

Figure 12:
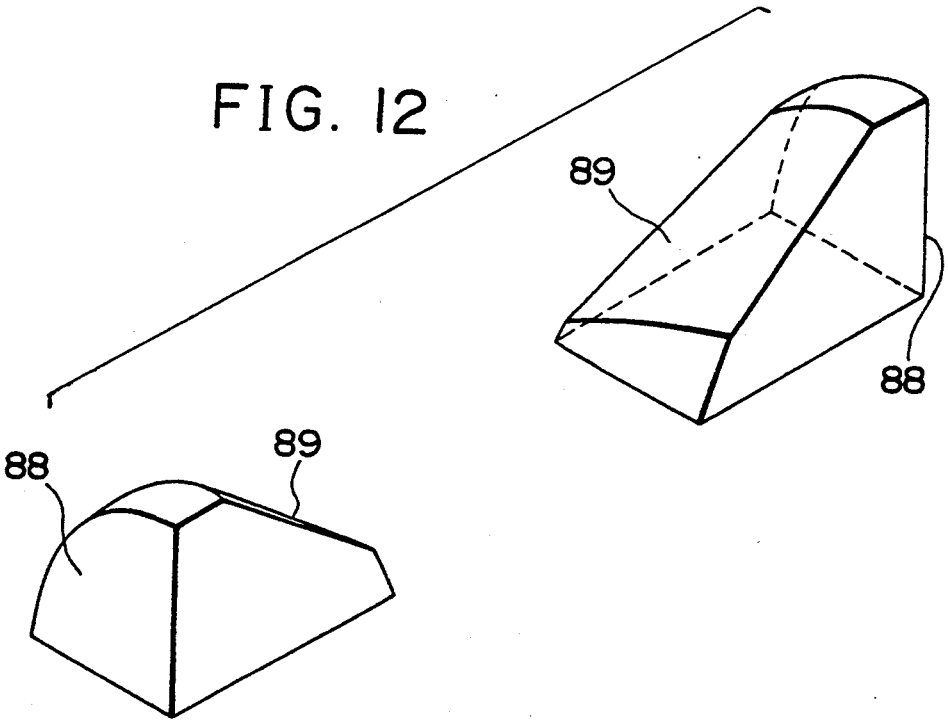
FIG. 12 is a perspective view of further modified guide members according to a fifth embodiment.

FIG. 12 shows still another modified form of guide members 88, 88 according to a fourth embodiment of the second invention. In each guide member 88, a slant surface 89 for guiding a sheet is a curved surface. In the third and fourth embodiments, likewise in the first and second embodiments, the slant surface 79, 89 has a height gradually increasing in the sheet supply direction, Sloping downwardly inwardly. The remaining parts of the third and fourth embodiments also similar in construction to those of the first and second embodiments.

According to each embodiment of the second invention, in a sorter connected with a printer, partly since a part (actually the uppermost bin) of plural bins is used as a non-sort tray, a pair of guide members are situated on opposite sides of the base at the sheet receiving side of the tray for curving the incoming printed sheet in a substantially U shape, as seen along a plane perpendicular to the sheet supply direction, in order to increase the apparent rigidness of the sheet, and partly since each guide member has a slant surface having a height increasing gradually in the sheet supply direction, the individual incoming printed sheet supplied from the printer 51 will fly over the tray, without bending in the sheet supply direction, and hence can fall onto the tray, during which the sheet keeps in a substantially horizontal posture. It is therefore possible to receive the printed sheets successively on the tray, without sliding on the print image surface of the previously received sheet on the tray.

What is claimed is:

1. A sorter for sorting sheets successively supplied thereto, comprising:

(a) a fixed frame;

(b) a movable frame movable vertically with respect to said fixed frame;

(c) a plurality of bins arranged one over another at a predetermined distance and each having an upper surface sloping upwardly in a sheet supply direction for receiving thereon one or more of the sheets, said bins being supported on said movable frame;

(d) a non-sort bin situated upwardly of said bins and supported pivotally on an upper portion of said movable frame for receiving the non-sorted sheets, said non-sort bin being biased normally so as to slant upwardly in the sheet supply direction; and (e) a holder mounted on said fixed frame, at a position to which the sheets are to be supplied, for holding said non-sort bin horizontally against the bias.

2. A sorter according to claim 1, further comprising a stopper movable vertically with said movable frame for holding, in place of said holder, said non-sort bin at a sort position in which the sheets are to be sorted.

3. A sorter according to claim 1, wherein said non-sort bin is equipped with an extender extendible in the sheet supply direction.

4. A sorter according to claim 1, further comprising a resilient member situated between said non-sort bin and said movable frame for normally biasing said non-sort bin.

5. A sorter according to claim 1, further comprising:

(a) a stopper situated at a downstream end of said non-sort bin for contact with the leading end of the individual sheet supplied to said non-sort bin;

(b) a pair of guide members situated on opposite sides of an upstream end of said non-sort bin, each of said guide member having a sheet guide surface slanting upwardly in the sheet supply direction and downwardly toward the center of said non-sort bin perpendicularly to the sheet supply direction.

* * * * *